United States Patent [19]

Stewart

[11] 4,232,919

[45] Nov. 11, 1980

[54] PORTABLE STAND FOR USE IN LOADING A MUZZLE LOADING RIFLE

[76] Inventor: Nelson C. Stewart, P.O. Box 862, Franklin, N.C. 28734

[21] Appl. No.: 708,434

[22] Filed: Jul. 26, 1976

[51] Int. Cl.[2] ..... A47B 91/00; A47F 7/00

[52] U.S. Cl. ..... 312/254; 211/64; 312/244

[58] Field of Search ..... 312/254, 244; 211/64; 248/188.6

[56] References Cited

U.S. PATENT DOCUMENTS

| | | | |
|---|---|---|---|
| 1,302,267 | 4/1919 | Zink | 211/64 |
| 1,863,756 | 6/1932 | Lufkin | 248/188.6 x |
| 2,623,639 | 12/1952 | Levy | 211/64 X |
| 2,919,058 | 12/1959 | Thompson | 211/64 X |

*Primary Examiner*—David H. Corbin

[57] ABSTRACT

This invention comprises a muzzle loading rifle stand to be used when loading a rifle through the muzzle. It comprises a base with an upright member attached thereto, having a channel for receiving the rifle in an upright position, there being a cushion on said base within said channel upon which the butt of the rifle may rest during the loading operation and a muzzle receiving member at the top of said upright member. The stand is also provided with a cabinet at the top with compartments for containing all the tools and other equipment used in the muzzle loading operation. Portions of the base fold against the sides of the upright member and a handle is provided for carrying the stand to and from the place of use.

10 Claims, 5 Drawing Figures

PORTABLE STAND FOR USE IN LOADING A MUZZLE LOADING RIFLE

In using a muzzle loading rifle, it is necessary to stand the rifle upright with the butt against the ground while powder is poured into the muzzle and pressed down tightly with a ram rod, and a ball is then pressed down on top of the powder. A hammer is used to drive the ball and powder down into position and considerable force is exerted against the powder and ball in this process. If the butt of the rifle is resting upon the ground, injury to the butt may result, to say nothing of the chance of soiling the butt. To avoid this, an operator may rest the butt upon his foot, thus suffering some discomfort. In addition, quite a number of tools and other equipment are necessary to carry out the process of cleaning and loading. This equipment must be in reach of the operator if the operation is to be done quickly and conveniently, and, if the operator is holding the muzzle of the rifle with one hand, he only has the other hand to manipulate the required tools.

It is the principal object of the invention to provide a stand for a muzzle loading rifle by means of which the rifle may be held in an upright position with the butt of the rifle protected against injury and soil and so as to leave both hands of the operator free to carry out the necessary operations.

Another object of the invention is to provide a muzzle loading rifle stand with a cabinet integral with or removably attached to the upper end of the stand for maintaining at hand all the equipment necessary for the loading operation.

Another object of the invention is to provide the top of the cabinet, referred to in the last paragraph, with a tray upon which may be placed various pieces of equipment for use in the loading operation and to provide a drawer with rows of receptacles for receiving balls to be loaded, the rows being parallel with front edge of the drawer, so that, as the drawer is pulled out, successive rows of balls will be made available, the number of balls in a row corresponding to the number of shots to be fired during one turn of the shooting.

Other objects of the invention will be apparent as the description of the invention proceeds.

The invention is illustrated in the accompanying drawings in which.

Figure 1:
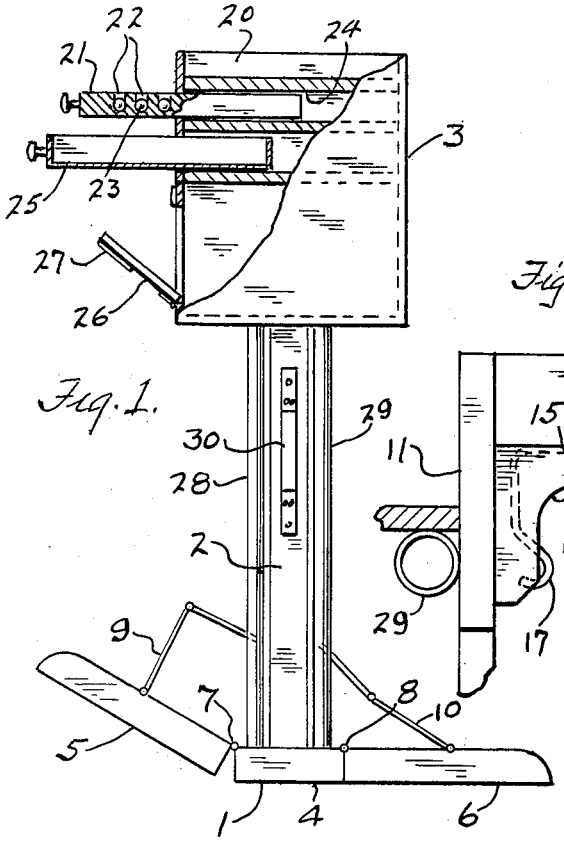
FIG. 1 is a rear view of the stand showing the cabinet at the top in partial section.

Referring now more specifically to the drawings, the stand comprises a base 1, an upright member 2, and a cabinet 3 rigidly or removably attached to the upright member. The base 1, which may preferably be made of wood, is in the form of a cross having a portion 4 extending from a point under the rear edge of the cabinetto a point beyond the front thereof and two side portions 5 and 6 of the same material and extending out to the sides a sufficient distance to provide a firm support for the stand. The portions 5 and 6 may be hinged to the portion 4 by hinges 7 and 8 so that they may be folded up against the upright member for ease in transporting and storing the stand. Suitable folding hinged braces 9 and 10 may be attached in any desirable manner to the portions 5 and 6 to lock them in their lowermost portion and yet permit raising them against the upright member when desired.

Figure 2:
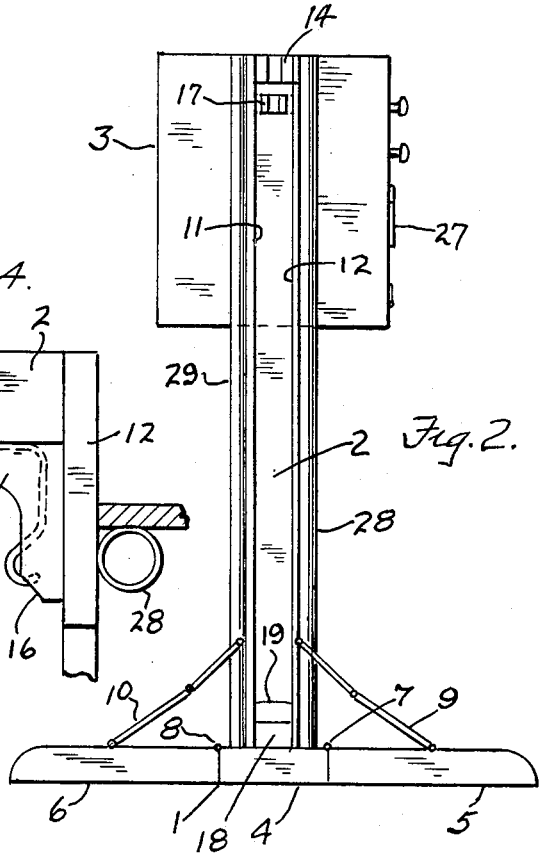
FIG. 2 is a front view of the stand showing the channel in which the rifle is positioned for the loading operation.
Figure 4:
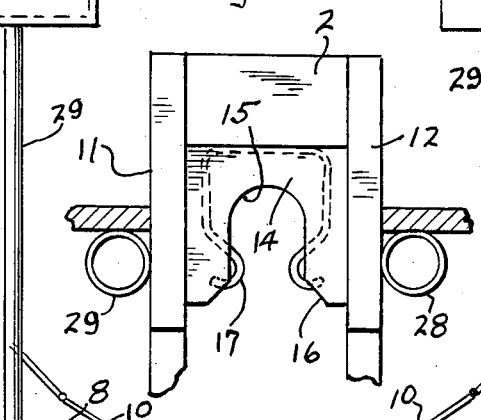
FIG. 4 is an enlarged plan view of a portion of the stand showing the upright member and the block for receiving the muzzle of the rifle, as well as the tubes for receiving the ram rod and cleaning rod.
Figure 3:
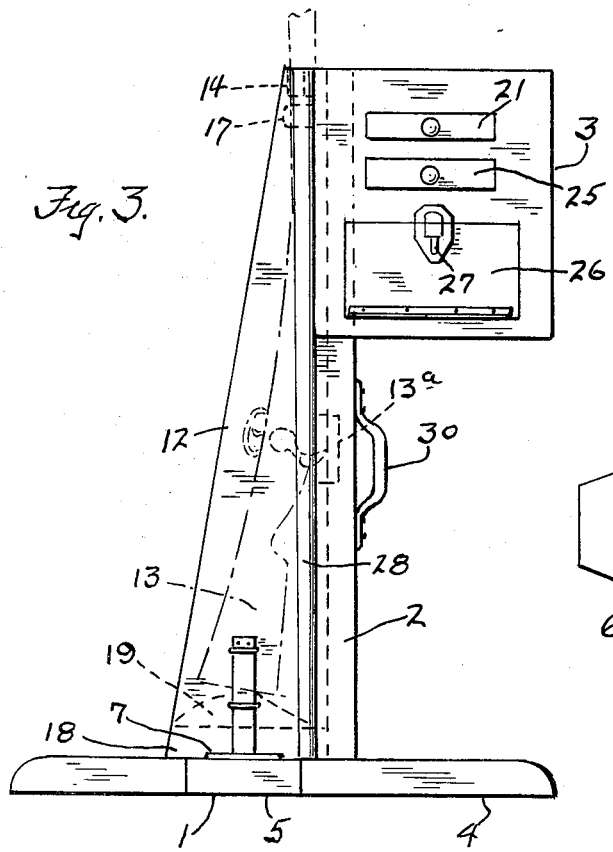
FIG. 3 is a side view of the stand taken from the right of FIG. 2, and showing a rifle in dot-and-dash lines in position for loading.
Figure 5:
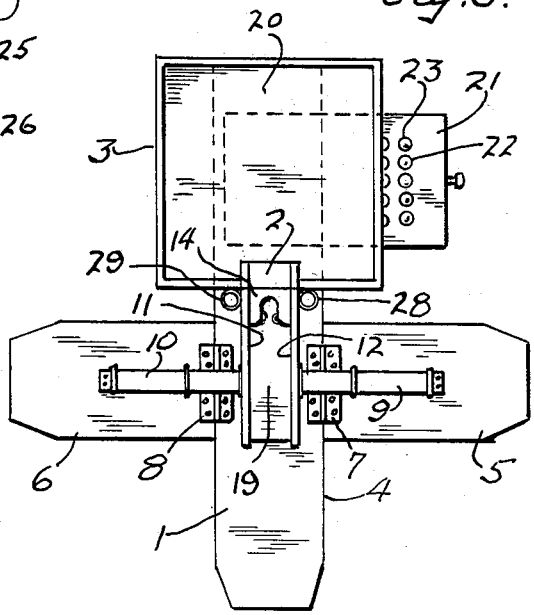
FIG. 5 is a plan view of the stand shown in the same scale as FIGS. 1, 2, and 3.

Side panels 11 and 12 are rigidly secured to the base 1 and to the upright member 2 and extend the entire length of the latter. These pannels are narrow ate the top and wide at the bottom, as clearly shown in FIG. 3 and form the channel in which the rifle 13, shown in dot-and-dash lines in FIG. 3, is positioned for the loading operation. Attached to the upright member 2 at the top and to the panels 11 and 12, is a muzzle receiving block 14, shown enlarged in FIG. 4, having an opening 15 which is just the right size for receiving the muzzle of the rifle and deeper than the diameter of the muzzle. Bevelled edges 16 may be provided for the opening to permit easy insertion of the muzzle. If desired, a spring clip 17 may be provided just below the block, as shown in FIGS. 2, 3, and 4, for releasably securing the muzzle in position. A recess **13*a* is provided in the upright member 2** to receive the hammer of the rifle.

I also preferably provide a block 18 on the base portion 4 between the panels 11 and 12 upon which I preferably secure a cushion 19 to receive the butt of the rifle. This cushion member may be contoured to fit the particular rifle butt with which the stand is to be used.

The cabinet 3 may be of any suitable size to contain the loading equipment. I have found it desirable to make it substantially 12½ inches square in cross section and 14 inches deep. It may be made of any desirable material, such as plastic or metal, although I prefer to make it out of wood. The top of the cabinet is recessed, as at 20, to form a tray upon which tools, powder, and other equipment may be placed when the stand is in use.

A drawer 21 is also provided, and I prefer to have it adjacent the top. This drawer is used to contain the balls or shots to be loaded into the rifle. The drawer may be made of a solid piece of wood with rows of holes 22 to receive the balls or shots 23. A feature of the invention is to provide these holes or receptacles in rows parallel to the front edge of the drawer, the number of holes in a row corresponding to the number of shots permitted in one turn of the competition. The drawer may be pulled out A sufficient distance to uncover one row of shots at a time thus reminding the operator of the number of shots fired in one turn. The holes or receptacles have a depth just sufficient for the tops of the balls or shots 23 to be flush with the top of the drawer, and within the cabinet a surface 24 is provided as a ceiling for the drawer opening so that the balls or shots can not fall out of the receptacles when the stand is transported or stored.

Below the drawer 21, I may provide a second drawer 25 in which may be stored small pieces of equipment. The bottom portion of the cabinet may be provided with a hinged door 26, secured in closed position with a suitable latch 27. In the compartment, thus provided, may be stored the larger pieces of equipment necessary for the loading operation.

In order to clean the muzzle of the rifle and to press the powder and ball in place, a cleaning rod and a ram rod (not shown) are needed which can be inserted in the muzzle. To provide housing for these rods, I preferably provide two tubes 28 and 29 which I preferably attach to the sides of the pannels adjacent the cabinet, as shown in FIGS. 1, 2, 3, and 4. These tubes may be made of alluminum and may extend the full length of the stand. One I use for storing the cleaning rod and the other for storing the ram rod.

For transporting the stand, I provide a handle 30 on the rear of the upright member near the cabinet and positioned in such a manner as to balance the weight of the base and the cabinet when the side portions 5 and 6 of the base are folded up against the upright member. In some instances I may provide a pair of wheels (not shown) on the forward end of the portion 4 of the base, so positioned as to engage the ground when the stand is tilted forward, to avoid the necessity of carrying the stand when transporting it. A suitable handle on the cabinet will facilitate wheeling the stand from place to place.

Many variations of the arrangement of the stand, shown and described, may be made without departing from the spirit of the invention, and I do not wish to limit myself to what has been shown and described except by the limitations of the appended claims.

What I desire to claim and secure by Letters Patent is:

1. A portable stand for use in loading a muzzle loading rifle comprising a base, an upright member rigidly attached to said base, means at the upper end of said upright member for receiving the muzzle of a rifle, cushion means attached to said base to receive the butt of said rifle, and channel means attached to said upright member into which said rifle can be inserted in an upright position with the butt of said rifle resting on said cushion means and the end of the muzzle of said rifle in said muzzle receiving means.

2. A portable stand, as defined in claim 1, further comprising spring means for retaining the muzzle of said rifle in said muzzle receiving means.

3. A portable loading rifle stand, as defined in claim 1, further comprising a cabinet attached to the upper end of said upright member and extending outwardly therefrom away from said muzzle receiving member, said cabinet adapted to contain tools and other equipment for performing the loading operation of the rifle.

4. A portable loading rifle stand, as defined in claim 3, in which the base is in the form of a cross comprising a first portion extending from a point substantially under the cabinet to a point beyond the cushion means for receiving the butt of said rifle and two additional portions extending respectively from the sides thereof, means for hinging said additional portions to said first portion to permit said additional portions to be raised towards said upright member, and retaining means for maintaining said additional portions in their lowermost positions to complete said base.

5. A portable loading rifle stand, as defined in claim 4, further comprising a handle for carrying said stand attached to said upright member between the cabinet and the base on the opposite side of said upright member from the rifle receiving channel means.

6. A portable loading rifle stand, as defined in claim 3, in which the cabinet comprises a compartment for containing tools and other equipment, and a drawer for containing balls to be fired from the rifle, said drawer having a flat upper surface, a plurality of cavities in said surface for receiving said balls, said cavities being of sufficient depth so that the upper surface of said balls will be flush with said upper surface of said drawer, and means within said cabinet to prevent said balls from coming out of said cavities when said drawer is in its closed position within said cabinet.

7. A portable loading refle stand, as defined in claim 6, further comprising a second drawer in the cabinet for containing small tools and other equipment, and a recess at the top of said cabinet forming a tray in which equipment may be placed when the stand is in use.

8. A portable loading rifle stand, as defined in claim 6, further comprising at least one tubular member attached to one of said side members and extending substantially parallel to the upright member for housing a rod used in the loading operation.

9. A portable loading rifle stand, as defined in claim 8, further comprising spring means for retaining the muzzle of the rifle in the muzzle receiving means.

10. A portable loading rifle stand, as defined in claim 6, in which the cavities in the drawer for receiving the balls are arranged in rows parallel to the front edge of the drawer, there being a predetermined number of cavities in each row.

* * * * *